United States Patent [19]

Egyptien et al.

[11] 3,955,775

[45] May 11, 1976

[54] TEXTILE TREATMENT TUBE

[75] Inventors: Josef Egyptien, Aachen; Walter Henning, Alsdorf-Begau, both of Germany

[73] Assignee: Messrs. Jos. Zimmermann, Aachen, Germany

[22] Filed: June 30, 1975

[21] Appl. No.: 591,698

[30] Foreign Application Priority Data

July 6, 1974 Germany ..... 7423096

[52] U.S. Cl. ..... 242/125.1; 242/18 PW

[51] Int. Cl.[2] ..... B65H 75/28

[58] Field of Search ..... 242/118.1, 118, 125.1, 242/18 PW, 18 EW, 118.11

[56] References Cited

UNITED STATES PATENTS

| | | | |
|---|---|---|---|
| 1,211,678 | 1/1917 | Connelly | 242/125.1 |
| 3,138,345 | 6/1964 | Luber | 242/118.1 X |
| 3,417,940 | 12/1968 | Hawkins | 242/125.1 |
| 3,887,145 | 6/1975 | Egyptien | 242/125.1 |

*Primary Examiner*—Edward J. McCarthy
*Attorney, Agent, or Firm*—Mason, Fenwick & Lawrence

[57] ABSTRACT

A textile treatment tube or spool, for example for dyeing purposes, has a thread end holding device at its lower end. This device is in the form of one or more than one thread retaining arm disposed at a short distance from the lower edge of the tube and extending in the longitudinal direction thereof towards its lower end. Moreover the device comprises a yarn-gripping channel immediately adjacent the arm or arms.

6 Claims, 10 Drawing Figures

TEXTILE TREATMENT TUBE

FIELD OF THE INVENTION

This invention relates to a textile treatment tube or spool, for instance for dyeing thread or yarn wound on it, having a circular groove for holding a reserve of yarn some distance from its lower edge and, between the circular groove and the lower edge, having a yarn-holding device which has at least one yarn-holding arm situated on the outside of the tube and a yarn-gripping channel adjacent to the arm or arms.

DESCRIPTION OF THE PRIOR ART

To permit continuous operation in a textile machine when unwinding thread from textile tubes, it is known to join the thread end of a first tube to the thread start of a second tube, and it is necessary that the first tube should have a thread reserve, and that its thread end should be accessible.

Such a thread reserve may be formed by providing, before winding on the tube, its lower end with a series of thread windings clear of the body of thread which will be formed on it during winding. To takeup the thread reserve, known tubes are formed with a circumferential groove near their lower edge.

To make the yarn end accessible a spool is known with a yarn-holding device at its lower end, which has at least one yarn-holding arm arranged on its exterior surface at a distance from its lower edge, and a yarn-gripping channel adjacent this arm. Both the yarn-holding arm and the yarn-gripping channel are arranged between the lower edge of the spool and a circular groove which is disposed at a distance from the lower edge and holds the yarn reserve. The yarn-holding arm extends approximately in the direction of the circumference of the spool and the yarn-gripping channel is behind that end of the yarn-holding arm which is connected to the spool.

When such a spool is used, firstly the free end of the yarn to be wound on is laid in the circular groove, in such a way that it lies in the opposite direction to the yarn-holding arm. Then the yarn end is laid round the yarn-holding arm, and subsequently the ensuing part of the yarn is passed over the yarn-gripping channel and laid in the circular groove. After this, to build up a yarn reserve, a number of turns are made in the groove, so that the free end of the yarn in the circular groove is more or less covered by the turns. To connect the end of the yarn wound on the spool to the beginning of the yarn wound on another spool, the end of the yarn must be picked up in the vicinity of the yarn-gripping channel, drawn out of the circular groove and removed from the yarn-holding arm.

Although satisfactory results have been obtained with this known spool, it has been found somewhat impractical that in order to secure the end of the yarn it must be passed from the circular groove, round the yarn-holding arm and subsequently laid in the circular groove again.

Another spool is known with a similar yarn-holding device. Between the lower edge of this spool and a circular groove disposed at a distance from it on the outside of the spool a pair of yarn-holding arms are provided, extending oppositely in the direction of the circumference of the spool, with in addition a yarn-gripping channel arranged between the two yarn-holding arms.

When using this spool, the free end of the yarn is laid in the circular groove. The end is then passed first round one of the yarn-holding arms according to the position of the free end of the yarn in the circular groove. In each case, however, the end of the yarn is then also passed round the other yarn-holding arm. After this, the end is then again laid in the circular groove.

With this spool satisfactory results have also been obtained. But, it has been found somewhat impractical that the end of the yarn must be passed from the circular groove round the yarn-holding arms and subsequently inserted again into the circular groove.

The object of the invention is to provide a textile treatment tube or spool with a yarn-holding device by which securing of the yarn end and building up of a yarn reserve can be achieved more simply than with the two known spools.

SUMMARY OF THE INVENTION

According to the invention there is provided a textile treatment tube or spool comprising an annular groove for holding a reserve of yarn the groove being disposed some distance from the lower edge of the tube; at least one yarn-holding arm between the groove and the said lower edge, the said arm being disposed on the outside of the tube; and a yarn-gripping channel adjacent the arm, which spool is characterised in that the arm extends approximately longitudinally of the spool with its free end directed towards the lower edge of the spool, the yarn-gripping channel being disposed immediately adjacent the yarn-holding arm.

This arrangement of the yarn-holding device makes possible laying of the yarn end in the annular groove, bringing it into engagement with the yarn-holding device, inserting it again in the groove and winding it in the groove without reversing its direction. The reason for this is that the yarn end, after it has been laid in the annular groove, can be passed along the free end of the yarn-holding arm and from there across the yarn-gripping channel and finally back into the annular groove.

As with the two known textile spools described above, the end of the yarn is also directly accessible for picking-up and drawing away, because of the presence of the yarn-gripping channel across which the yarn end is passed.

Also, as with the yarn-holding devices of the known spools, the present yarn-holding device permits through-dyeing of the yarn end, since the dye liquor has access to all parts of the yarn end.

In one advantageous embodiment, a pair of yarn-holding arms have the yarn-gripping channel between them. The paired arms have the advantage that securing of the yarn end is carried out very easily. As a consequence of the paired arms the end of the yarn can be laid in the annular groove equally well in either direction, passed along the yarn-holding arms and the yarn-gripping channel, and passed back into the groove. Also, picking up the end of the yarn in the yarn-gripping channel whilst drawing it out of the spool is made easier.

The yarn-holding arm and the yarn-gripping channel may lie within the outer peripheral surface of the spool, and be formed by cut-outs in the spool. Thus the spool has no projecting parts which might cause problems during its manufacture, use and storage.

To make passing of the yarn end at the free end of each yarn-holding arm easier, provision may also be made for each yarn-holding arm rim which is turned away from the yarn-gripping channel to be situated partly of a distance from the surface of the cut-out of the spool by which the arm is formed.

The free end of each yarn-holding arm may extend to a point at a distance above the lower edge of the spool, which distance is somewhat greater than the thickness of the yarn which is to be wound. The yarn-gripping channel can extend with increasing width and depth approximately from the annular groove to the lower edge of the spool, so that its lower part lies radially further inward than the inner surface of the arm or arms. With these characteristics of the yarn-holding device, the yarn can be secured in a very simple manner, and can be picked up very easily at the yarn-gripping channel and drawn from the spool.

The spool can be cylindrical or frusto-conical in shape.

For use as a dyeing spool it may have holes or ports for passage of the dye liquor, in which case, the spool may also be of different design and consist for example of spaced rings with connecting webs.

If the spool is used for winding up thread only, it may have a casing without perforations or openings.

Preferably, the spool is of thermoplastics material so that all its parts, including the yarn-holding device, are made in one piece.

DESCRIPTION OF THE PREFERRED EMBODIMENTS

Figure 2:
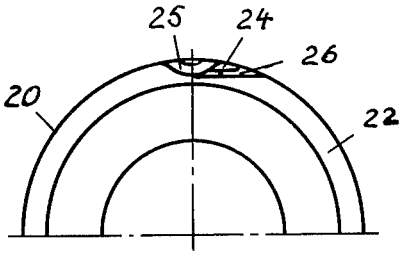
FIG. 2 is an underneath plan of one half of the dyeing tube.
Figure 5:
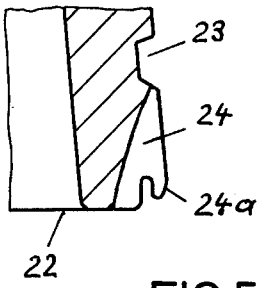
FIG. 5 is an enlarged part section on line C-D of FIG. 1.
Figure 1:
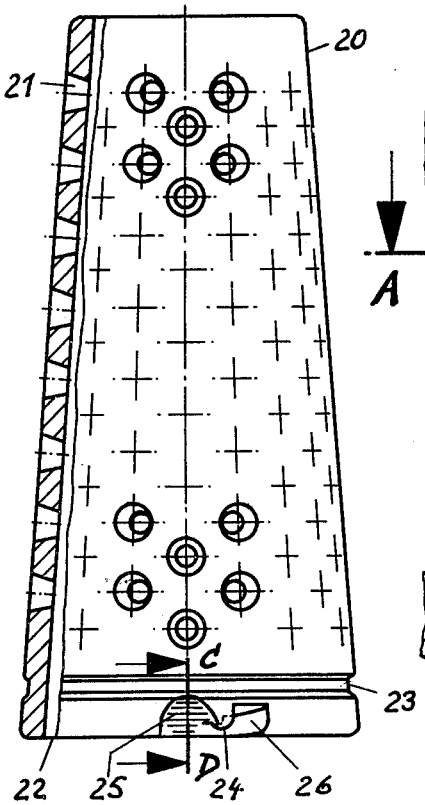
FIG. 1 is a side elevation, partly broken away and in longitudinal section, of a first embodiment of dyeing tube or spool.
Figure 3:
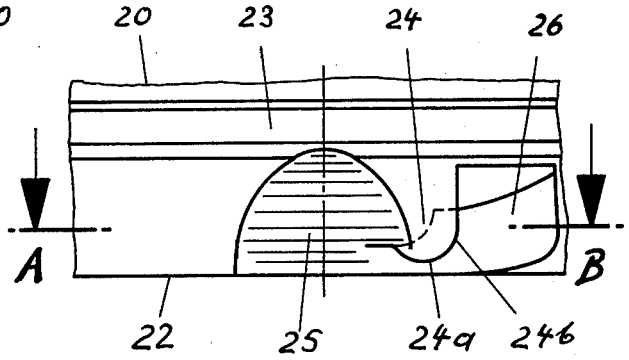
FIG. 3 is an enlarged part side elevation, showing the yarn-holding device.
Figure 4:
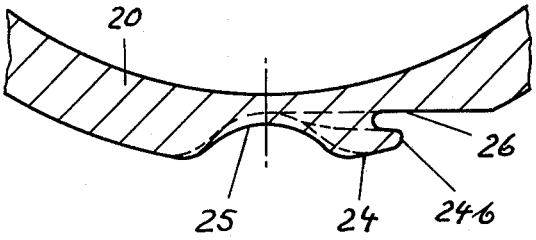
FIG. 4 is an enlarged part section on line A-B of FIG. 3.

The embodiment of dyeing spool or tube shown in FIGS. 1 to 5 is frusto-conical, tapering upwardly, and is of thermoplastics plastic.

The body 20 of the spool, with the exception of its upper and lower end areas, has evenly distributed holes 21 for passage of dye liquor. Spaced from the lower spool edge 22 is an annular circumferential groove 23 for holding a reserve of yarn.

At the lower end of the spool a yarn-holding device is arranged between the groove 23 and the edge 22.

This yarn-holding device has a yarn-holding arm 24 which extends more or less from the groove 23 approximately longitudinally of the spool, and its free end 24*a* is turned towards the lower edge 22. Further, the yarn-holding device has on the left next to the arm 24 a yarn-gripping channel 25, which is located immediately adjacent the arm 24 and extends from the groove 23 tc the lower edge 22.

The arm 24 is situated within the outer peripheral surface of the spool body 20 and is formed by a cut-out 26 in that part of the body which is next to it. Thus the cut-out 26 is shaped in such a way that the lower end 24*a* of the arm 24 is free. Further, the cut-out 26 is shaped in such a way that the yarn-holding arm 24 has its rim 24*b* (which is turned away from the channel 25) situated partly at a distance from the surface of the cut-out 26. The free end 24*a* of the arm 24 extends to a point at a distance above the lower edge 22 which distance is somewhat greater than the thickness of the yarn to be wound on the spool. In addition the free end 24*a* of the arm 24 is rounded, see FIG. 3.

The channel 25 situated on the left next to the arm 24 is also arranged within the outer peripheral surface of the body and is also formed by a cut-out. The yarn-gripping channel 25 extends with increasing width and depth approximately from the groove 23 to the lower edge 22, whereby its lower part is radially further inward, than the inside surface of the arm 24.

During use of the spool, the yarn end is first laid in the annular groove 23 in such a way that it extends to the right with reference to the yarn-holding arm 24. Subsequently the yarn end is wound in the groove 23 approximately once round the spool. The yarn end is then passed out of the groove 23 along the cut-out 26 under and behind the rim 24*b* as well as the free end 24*a* of the arm 24, and thence along the yarn-gripping channel 25 and back into the groove 23. After this, to build up a reserve of yarn, a number of turns are wound in the groove 23, so that the yarn end in the groove 23 is more or less covered by the turns. Subsequently, the spool can be wound with the yarn in the normal way by building up a roll of yarn.

In use, unobstructed through-dyeing of the yarn end which passes along the arm 24 and channel 25 can take place, being directly accessible to the dye liquor.

In order subsuquently to join the end of the wound-on yarn to the beginning of the yarn wound on another spool it is only necessary to grasp the free end of the yarn in the vicinity of the channel 25 and to draw it out of the groove 23, which can be done without difficulty. For the joining operation only the reserve of yarn needs to be unwound subsequently, as is normal practice.

Figure 7:
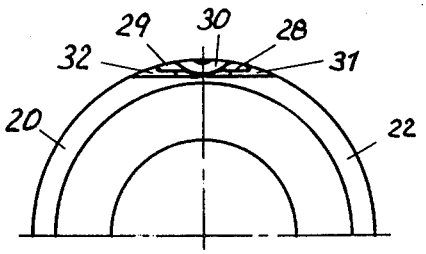
FIG. 7 is an underneath plan of one half of the tube of the second embodiment.
Figure 10:
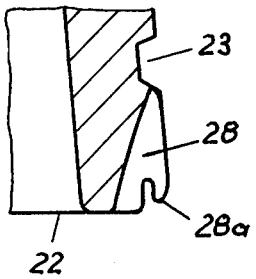
FIG. 10 is an enlarged part section on line H-J of FIG. 6.
Figure 6:
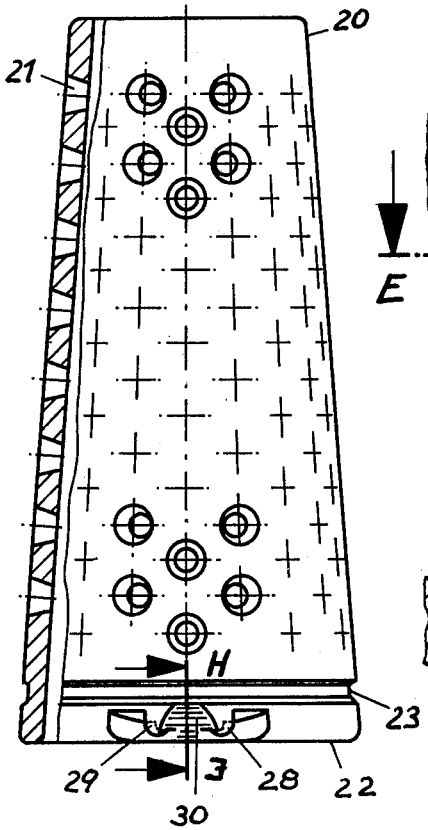
FIG. 6 is a view similar to FIG. 1 of a second embodiment.
Figure 8:
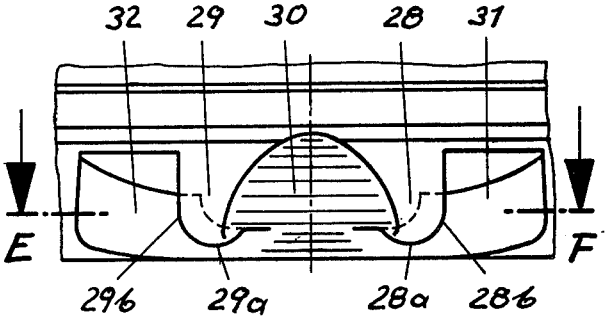
FIG. 8 is an enlarged part side elevation of the second embodiment showing the yarn-holding device.
Figure 9:
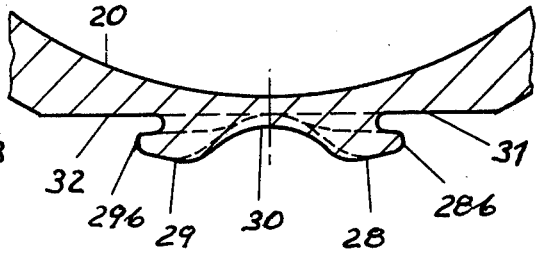
FIG. 9 is an enlarged part section on line E-F of FIG. 8.

The embodiment of dyeing spool shown in FIGS. 6 to 10 corresponds to a considerable degree to that of FIGS. 1 to 5.

The parts of the second embodiment which are the same as of the first embodiment have been allotted the same reference numbers.

This second spool embodiment has two yarn-holding arms 28 and 29, instead of one. The two arms 28, 29 are arranged as a pair, and between them is a yarn-gripping channel 30.

The yarn-holding arm 28 is the same as the yarn-holding arm 24 of the first spool. The yarn-holding arm 29 is a mirror image of the arm 28. The yarn-gripping channel 30 between the yarn-holding arms 28, 29 corresponds approximately to the channel 25 of the first spool.

Similarity, a cut-out 31 forms the arm 28, and a cut-out 32 the arm 29. Further, the arm 28 has a lower free end 28*a* and a lateral rim 28*b* situated partly at a distance from the surface of the cut-out 31. Correspondingly, the arm 29 has a lower free end 29*a* as well as a partly free lateral rim 29*b*.

The same method of operation is used for the second spool as for the first. However, the free end of the yarn in this instance can be arranged in the groove 23 equally well in either direction. After the yarn end is approximately wound in the groove 23 once round the spool, it is passed along the cut-out 31, the yarn-holding arm 28, the yarn-gripping channel 30, the yarn-holding arm 29 and the cut-out 32, or vice versa, according to the direction of winding, and finally re-inserted in the groove 23. Thus the yarn end is passed under and behind the free ends 28*a*, 29*a* of the arms 28, 29 as well as the rims 28*b*, 29*b*. In addition the channel 30 is passed over in its lower region by one part of the yarn end, which makes it particularly easy to grasp the end of the yarn later and to free it in order to join it to the beginning of the yarn wound on another spool.

What we claim is:

1. A textile treatment tube or spool comprising an annular groove for holding a reserve of yarn the groove being disposed some distance from the lower edge of the tube; at least one yarn-holding arm between the groove and the said lower edge, the said arm being disposed on the outside of the tube; and a yarn-gripping channel adjacent the arm, characterised in that the arm extends approximately longitudinally of the spool with its free end directed towards the lower edge of the spool, the yarn-gripping channels being disposed immediately adjacent the yarn-holding arm.

2. A spool according to claim 1 characterised in that it has a pair of yarn-holding arms, the yarn-gripping channel being disposed between the two arms.

3. A spool according to claim 1 characterised in that each yarn-holding arm and the yarn-gripping channel are disposed within the outer peripheral surface of the spool and are formed by cut-outs in the spool.

4. A spool according to claim 1 characterised in that the rim of each yarn-holding arm, which rim is turned away from the yarn-gripping channel, is positioned partly at a distance from the surface of a cut-out in the spool by which the arm is formed.

5. A spool according to claim 1 characterised in that the free end of each yarn-holding arm extends to a point at a distance above the lower edge of the spool which distance is somewhat greater than the thickness of the yarn which the spool is designed to receive.

6. A spool according to claim 1 characterised in that the yarn-gripping channel extends with increasing width and depth approximately from the annular groove to the lower edge of the spool, such that its lower part is disposed radially further inward than the inside surface of the or each yarn-holding arm.

* * * * *